US011326500B2

(12) United States Patent
Kubo et al.

(10) Patent No.: US 11,326,500 B2
(45) Date of Patent: May 10, 2022

(54) ATTACHMENT STRUCTURE FOR EXHAUST GAS SENSOR

(71) Applicant: HONDA MOTOR CO., LTD., Tokyo (JP)

(72) Inventors: Toshihiro Kubo, Wako (JP); Yuji Kurasawa, Wako (JP); Hiroshi Tadokoro, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 16/651,375

(22) PCT Filed: Sep. 29, 2017

(86) PCT No.: PCT/JP2017/035562
§ 371 (c)(1),
(2) Date: Mar. 27, 2020

(87) PCT Pub. No.: WO2019/064514
PCT Pub. Date: Apr. 4, 2019

(65) Prior Publication Data
US 2020/0291843 A1 Sep. 17, 2020

(51) Int. Cl.
*F01N 13/00* (2010.01)
*F01N 13/08* (2010.01)

(52) U.S. Cl.
CPC ..... *F01N 13/008* (2013.01); *F01N 13/082* (2013.01); *F01N 2340/04* (2013.01); *F01N 2590/04* (2013.01)

(58) Field of Classification Search
CPC ..... F01N 13/008
See application file for complete search history.

(56) References Cited

U.S. PATENT DOCUMENTS

| | | | | |
|---|---|---|---|---|
| 2006/0201742 | A1* | 9/2006 | Terashima | F01N 1/084 181/227 |
| 2014/0020940 | A1 | 7/2014 | Nakamura et al. | |
| 2014/0209401 | A1 | 7/2014 | Nakamura et al. | |
| 2017/0184005 | A1 | 6/2017 | Yamamoto | |

FOREIGN PATENT DOCUMENTS

| | | | | |
|---|---|---|---|---|
| EP | 1643096 | | 4/2006 | |
| EP | 1900624 | | 3/2008 | |
| EP | 1900624 | A1 * | 3/2008 | B62K 11/04 |
| JP | 2008-069705 | | 3/2008 | |
| JP | 2011256785 | A * | 12/2011 | |
| JP | 2012-047118 | | 3/2012 | |

(Continued)

OTHER PUBLICATIONS

Extended European Search Report for European Patent Application No. 17927726.4 dated Sep. 2, 2020.

(Continued)

*Primary Examiner* — Anthony Ayala Delgado
(74) *Attorney, Agent, or Firm* — Amin, Turocy & Watson, LLP

(57) ABSTRACT

An attachment structure for an exhaust gas sensor, wherein an exhaust gas sensor is attached to a downstream connection pipe part of an exhaust pipe so as to be disposed, in a side view of a motorcycle, in a spatial region between a footrest and a brake pedal provided to the motorcycle.

9 Claims, 4 Drawing Sheets

(56) References Cited

FOREIGN PATENT DOCUMENTS

| | | |
|---|---|---|
| JP | 2015-175241 | 10/2015 |
| JP | 2016-000978 | 1/2016 |
| JP | 2017-120026 | 7/2017 |

OTHER PUBLICATIONS

Hepco&Becker: "Engine protection plate aluminium for Honda XL 700 V Transalp", Aug. 13, 2020 (Aug. 13, 2020), XP055722399, Retrieved from the Internet: URL:https://www.hepco-shop.de/en/engine-protection-plate-aluminium-for-honda-xl-700-v-transalp.html[retrieved on Aug. 13, 2020].

Cmsnl.Com: "Exhaust system Honda XL 700V Transalp (2008)", Aug. 13, 2020 (Aug. 13, 2020), XP055722404, Retrieved from the Internet: URL:https://images.cmsnl.com/img/ partslists/honda-xl700v-transalp-2008-8-franceabs-exhaust-muffler_big00029596f_2000_8ca9.gi f [retrieved on Aug. 13, 2020].

Motorradteile Berndorf: "Honda XL 700 Transalp RD13 Krummer mit KAT, gebrauchtes unfallfreies Motorradersatzteil MotorradTeile Berndorf", Aug. 13, 2020 (Aug. 13, 2020), XP055722406, Retrieved from the Internet: URL:https://www. motorradteile-berndorf.de/honda-xl-700-transalp-rdl3-kruemmer-mit-kat [retrieved on Aug. 13, 2020].

Indian Office Action for Indian Patent Application No. 202017017290 dated Nov. 4, 2020.

International Search Report and Written Opinion for International Application No. PCT/JP2017/035562 dated Oct. 31, 2017, 8 pages.

* cited by examiner

ATTACHMENT STRUCTURE FOR EXHAUST GAS SENSOR

TECHNICAL FIELD

The present invention relates to an attachment structure for an exhaust gas sensor that detects an exhaust gas flowing through an exhaust pipe connected to an internal combustion engine of a saddle-type vehicle.

BACKGROUND ART

For example, Japanese Laid-Open Patent Publication No. 2015-175241 discloses an exhaust pipe that extends downward from the exhaust port of an internal combustion engine of a saddle-type vehicle, passes below the internal combustion engine, and extends backward.

SUMMARY OF INVENTION

In such an exhaust pipe, a catalyst is provided between the exhaust port and the lower part of the exhaust pipe. When an exhaust gas sensor that detects the exhaust gas flowing through the exhaust pipe is provided in the region on the lower side of the internal combustion engine on the lower side (downstream side) of the catalyst in the exhaust pipe, a protective member such as a cover member is required separately to properly protect the exhaust gas sensor from flicked stones, contact with the driver's foot, and an external force caused by an external impact or the like during a travel of a vehicle.

An object of the present invention is to provide an attachment structure for an exhaust gas sensor capable of suppressing effects of an external force without separately providing a protective member such as a cover member.

The present invention is an attachment structure for an exhaust gas sensor of a saddle-type vehicle that includes an internal combustion engine, an exhaust pipe connected to the internal combustion engine, and the exhaust gas sensor that is attached to the exhaust pipe and detects the exhaust gas flowing through the exhaust pipe and has the following features.

A first feature; the exhaust gas sensor is disposed in a region between a brake pedal of the saddle-type vehicle and a footrest of the saddle-type vehicle in side view of the saddle-type vehicle.

A second feature; in the side view, the exhaust gas sensor is disposed in a region between a depressed part provided at an end of the brake pedal and the footrest.

A third feature; the exhaust gas sensor is disposed so that at least a part thereof overlaps with the internal combustion engine in plane view of the saddle-type vehicle.

A fourth feature; the exhaust gas sensor is disposed below a case of the internal combustion engine.

A fifth feature; the exhaust gas sensor is disposed below a cover member provided for the case on an outer side of a vehicle width direction of the saddle-type vehicle.

A sixth feature; the exhaust gas sensor is disposed obliquely with respect to the vertical direction of the saddle-type vehicle.

A seventh feature; the exhaust gas sensor is attached to the exhaust pipe, extending obliquely upward from the exhaust pipe toward the outer side in the vehicle width direction of the saddle-type vehicle.

An eighth feature; the exhaust pipe includes a first pipe part that extends toward rear of the saddle-type vehicle from an exhaust port of the internal combustion engine while being inclined to an inner side in the vehicle width direction of the saddle-type vehicle, and a second pipe part that is joined to a rear end part of the first pipe part and extends toward the rear of the saddle-type vehicle while being inclined to an outer side in the vehicle width direction. The exhaust gas sensor is disposed in a region formed by connecting a front end part of the first pipe part to be connected to the exhaust port, the exhaust pipe, and rear end parts of the second pipe part in plane view of the saddle-type vehicle.

A ninth feature; in the plane view, the exhaust gas sensor is disposed in a region between the brake pedal and portions of the first pipe part and the second pipe part, the portions being inwardly bent in the vehicle width direction.

According to the first feature of the present invention, during operation of the saddle-type vehicle, the exhaust gas sensor can be covered with the driver's foot or the like from the outside in the vehicle width direction. As a result, effects of an external force on the exhaust gas sensor can be suppressed without separately providing a protective member such as a cover member.

According to the second feature of the present invention, by disposing the exhaust gas sensor in the region formed by connecting the depressed part, the footrest, and the brake pedal, the exhaust gas sensor can be easily covered with the driver's foot or the like from the outside in the vehicle width direction during operation of the saddle-type vehicle. As a result, the exhaust gas sensor can be more actively protected from the external force.

According to the third feature of the present invention, the presence of the internal combustion engine can effectively prevent the driver's foot or the like from making contact with the exhaust gas sensor.

According to the fourth feature of the present invention, the case for protecting the internal combustion engine can effectively protects the exhaust gas sensor from an external force.

According to the fifth feature of the present invention, since the cover member and the exhaust gas sensor are arranged along the vertical direction of the saddle-type vehicle, maintainability can be improved while the exhaust gas sensor is protected from an external force by the cover member.

According to the sixth feature of the present invention, the upper end of the exhaust gas sensor can be set at a lower position and the degree of freedom of design can be improved.

According to the seventh feature of the present invention, the exhaust gas sensor can be easily attached or detached from the side of the saddle-type vehicle, so maintainability can be further improved.

According to the eighth feature of the present invention, since the exhaust gas sensor is disposed in the region (space part) on the inside in the vehicle width direction formed by the exhaust pipe, it is possible to prevent the exhaust gas sensor from interfering with the operation of the saddle-type vehicle.

According to the ninth feature of the present invention, it is possible to effectively prevent the exhaust gas sensor from interfering with the operation of the saddle-type vehicle.

DESCRIPTION OF EMBODIMENTS

The present invention will be described in detail below by adopting a preferred embodiment and referencing the attached drawings.

1. Schematic Structure of a Motorcycle 10

Figure 1:
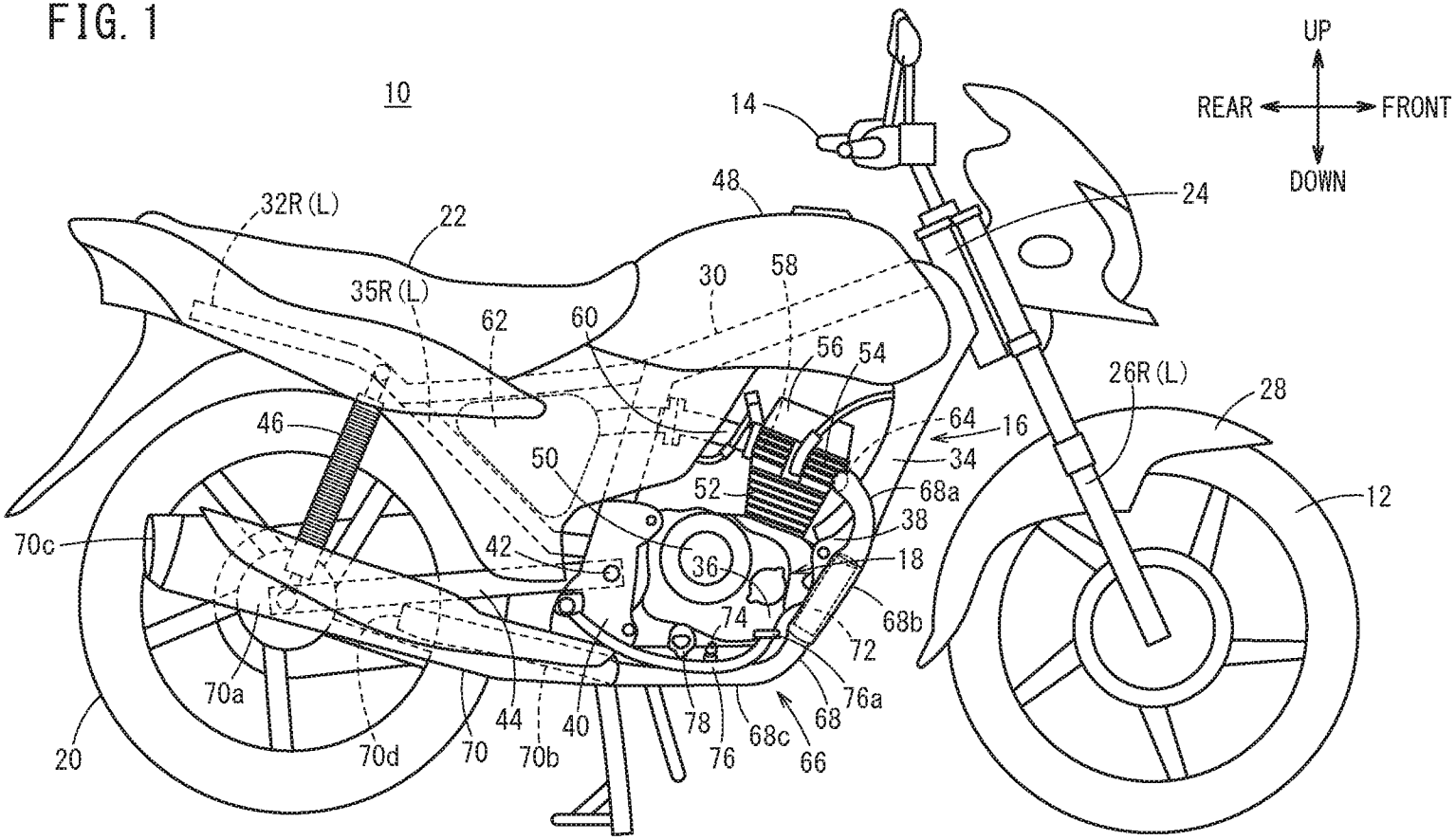
FIG. 1 is a right-side view illustrating a motorcycle to which an attachment structure according to an embodiment is applied.

FIG. 1 is a right-side view illustrating a motorcycle 10 which a saddle-type vehicle to which the attachment structure for an exhaust gas sensor 74 according to an embodiment (hereinafter, the attachment structure according to the embodiment) is applied. In the embodiment, the front-rear direction, the left-right direction, and the up-down direction are determined based on the direction seen from the driver (occupant) who sits on the motorcycle 10. In the following description, for a pair of left and right components arranged in the vehicle width direction (left-right direction) of the motorcycle 10, the reference numeral of the component on the left side may be followed by symbol "L" and the reference numeral of the component on the right side may be followed by symbol "R".

The motorcycle 10 includes a front wheel 12 that is a steering wheel, a handle 14 that steers the front wheel 12, a body frame 16 that configures a vehicle body, an internal combustion engine 18 that is a driving source, a rear wheel 20 that is a driving wheel, a seat 22, and the like.

The front wheel 12 is provided in front part of the vehicle body and rotatably supported by a pair of left and right front forks 26L and 26R axially supported by a head pipe 24 of the body frame 16. A front fender 28 that extends so as to cover the front wheel 12 is attached to the front forks 26L and 26R. A steering shaft is rotatably held by the head pipe 24, and the handle 14 is jointed to the upper end part of the steering shaft. The handle 14 symmetrically extends in the vehicle width direction with respect to a portion joined to the steering shaft, and the orientation of the front wheel 12 can be changed via the steering shaft and the front forks 26L and 26R by the driver operating the handle 14.

The body frame 16 includes: the head pipe 24; a mainframe 30 that is joined to the head pipe 24, extends backward while being slightly inclined obliquely downward, and has a rear end part bent and then extending downward; a pair of left and right seat rails 32L and 32R extending obliquely upward and backward from the bent portion of the mainframe 30; and one down frame 34 extending backward from the head pipe 24 while being inclined obliquely downward. The seat rails 32L and 32R are supported by support frames 35L and 35R that join the rear end part of the mainframe 30 to the seat rails 32L and 32R.

The front part of a crankcase 36 constituting the internal combustion engine 18 is attached to a support bracket 38 which is a lower part of the down frame 34. In addition, the rear part of the crankcase 36 is attached to a support bracket 40 provided at the rear end part of the mainframe 30. In this way, the internal combustion engine 18 is supported by the body frame 16.

A rear fork 44 extending backward is pivotally supported by a pivot shaft 42 provided in the rear end part of the mainframe 30, and the rear wheel 20 is axially supported by the rear end part of the rear fork 44. A rear cushion 46 is provided between the rear fork 44 and the seat rail 32R.

A fuel tank 48 is provided at a portion above the internal combustion engine 18 in the mainframe 30, stretching between the left and right sides of the portion. The seat 22 is provided behind the fuel tank 48, being supported by the seat rails 32L and 32R.

Here, the internal combustion engine 18 is, for example, a SOHC single-cylinder four-stroke internal combustion engine and is hung in a posture where a crankshaft (not illustrated) is oriented toward the vehicle width direction with respect to the vehicle body and the cylinder stands upright being slightly inclined forward. On the right side of the crankcase 36, a cover member 50 for protecting an AC electric generator (ACG), a clutch, and the like that constitute the internal combustion engine 18 is attached.

In addition, in the internal combustion engine 18, obliquely above the crankcase 36 that houses the crankshaft, a cylinder block 52 and a cylinder head 54 are disposed sequentially in this order on the crankcase 36, and the upper end of the cylinder head 54 is covered with a cylinder head cover 56. Accordingly, the cylinder block 52, the cylinder head 54, and the cylinder head cover 56 project from the crankcase 36 while being slightly inclined forward.

An intake pipe 60 is connected to an intake port 58 provided in the rear surface of the cylinder head 54. The intake pipe 60 extends backward and is joined to an air cleaner 62. The air cleaner 62 is supported by the mainframe 30, the seat rails 32L and 32R, and the support frames 35L and 35R. On the other hand, an exhaust pipe 66 is connected to an exhaust port 64 provided in the front surface of the cylinder head 54. The exhaust pipe 66 has: a first pipe part 68 that is bent downward from the cylinder head 54, extends along the down frame 34, is further bent backward, and extends backward below the internal combustion engine 18; and a second pipe part 70 that is joined to the rear end part of the first pipe part 68 and extends backward.

The first pipe part 68 includes: an upstream connection pipe part 68*a* that is connected to the exhaust port 64 and bent downward from the cylinder head 54; a cylindrical catalyst outer cylinder 68*b* that is connected to the rear end part of the upstream connection pipe part 68*a* and houses a catalyst 72; and a downstream connection pipe part 68*c* that is connected to the rear end part of the catalyst outer cylinder 68*b* and is bent and extends backward. The downstream connection pipe part 68*c* is provided with the exhaust gas sensor 74 that detects the exhaust gas that is discharged from the exhaust port 64, passes through the catalyst 72, and flows through the downstream connection pipe part 68*c* toward the second pipe part 70 (downstream side).

The second pipe part 70 includes a muffler 70*a* and a diffuser pipe 70*b* inserted into the muffler 70*a* and connected to the downstream connection pipe part 68*c*.

A brake pedal 76 to be operated by a foot of the driver sitting in the seat 22 is joined to the rear end part (the support bracket 40) of the mainframe 30. The brake pedal 76 extends, below the internal combustion engine 18, forward from the rear end part of the mainframe 30 along the downstream connection pipe part 68*c* and has, at the front end part thereof a depressed part 76*a* to be depressed by the driver's foot. In addition, a footrest 78 on which the driver's foot is placed during a travel of the motorcycle 10 is provided between the bottom part of the internal combustion engine 18 and the brake pedal 76.

2. Description of the Attachment Structure

Next, the attachment structure according to the embodiment will be described with reference to FIGS. 1 to 4.

Figure 2:
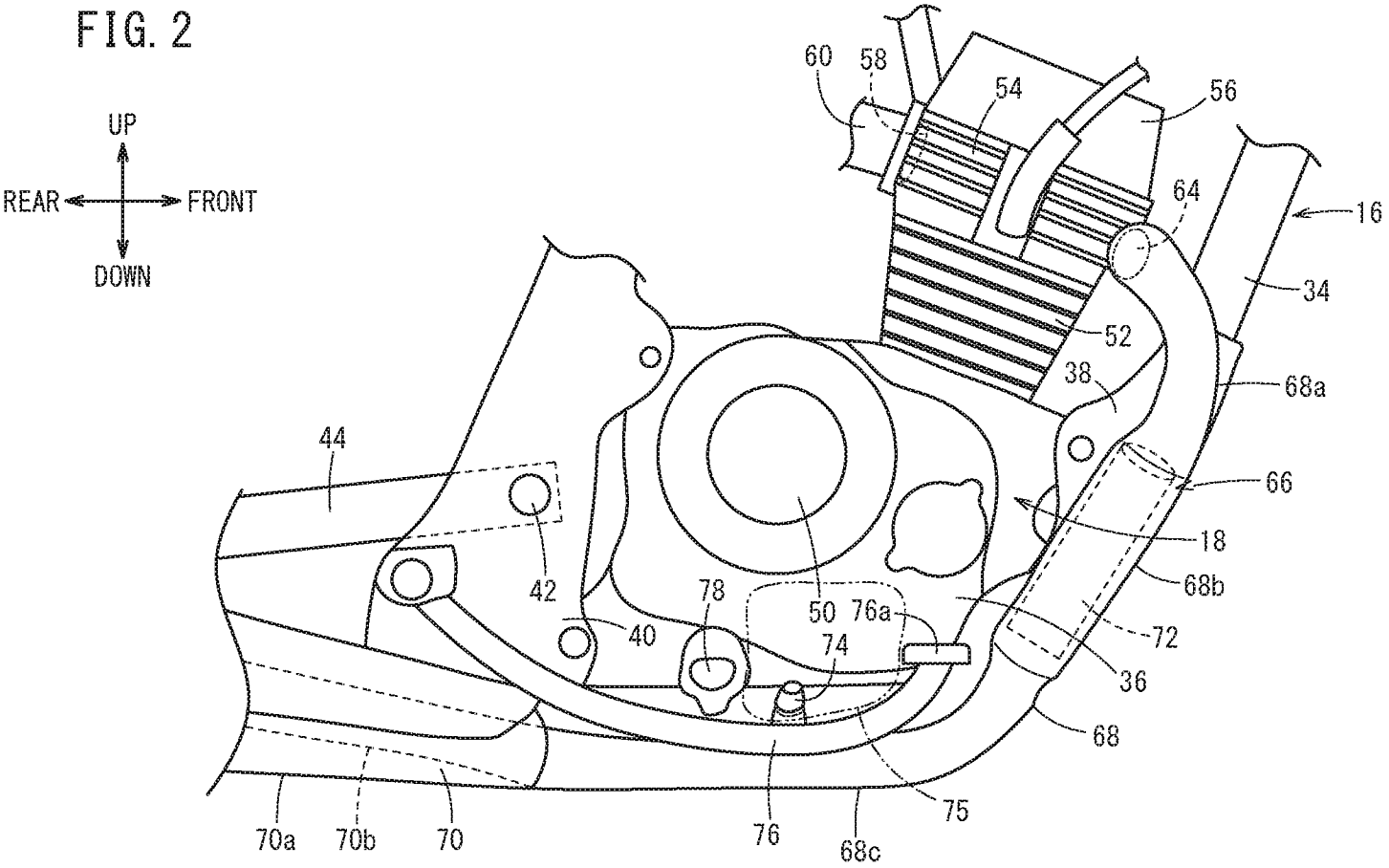
FIG. 2 is an enlarged side view illustrating an internal combustion engine and an exhaust pipe in FIG. 1.

In the attachment structure according to the embodiment, in side view in FIGS. 1 and 2, the exhaust gas sensor 74 is attached to the downstream connection pipe part 68*c* so as to be disposed in the spatial region between the brake pedal 76 and the footrest 78. More specifically, in side view in FIG. 2, the exhaust gas sensor 74 is disposed in a spatial region 75 between the depressed part 76*a* provided at the end of the brake pedal 76 and the footrest 78. FIG. 2 schematically illustrates the range of the spatial region 75 by a two-dot chain line.

Figure 3:
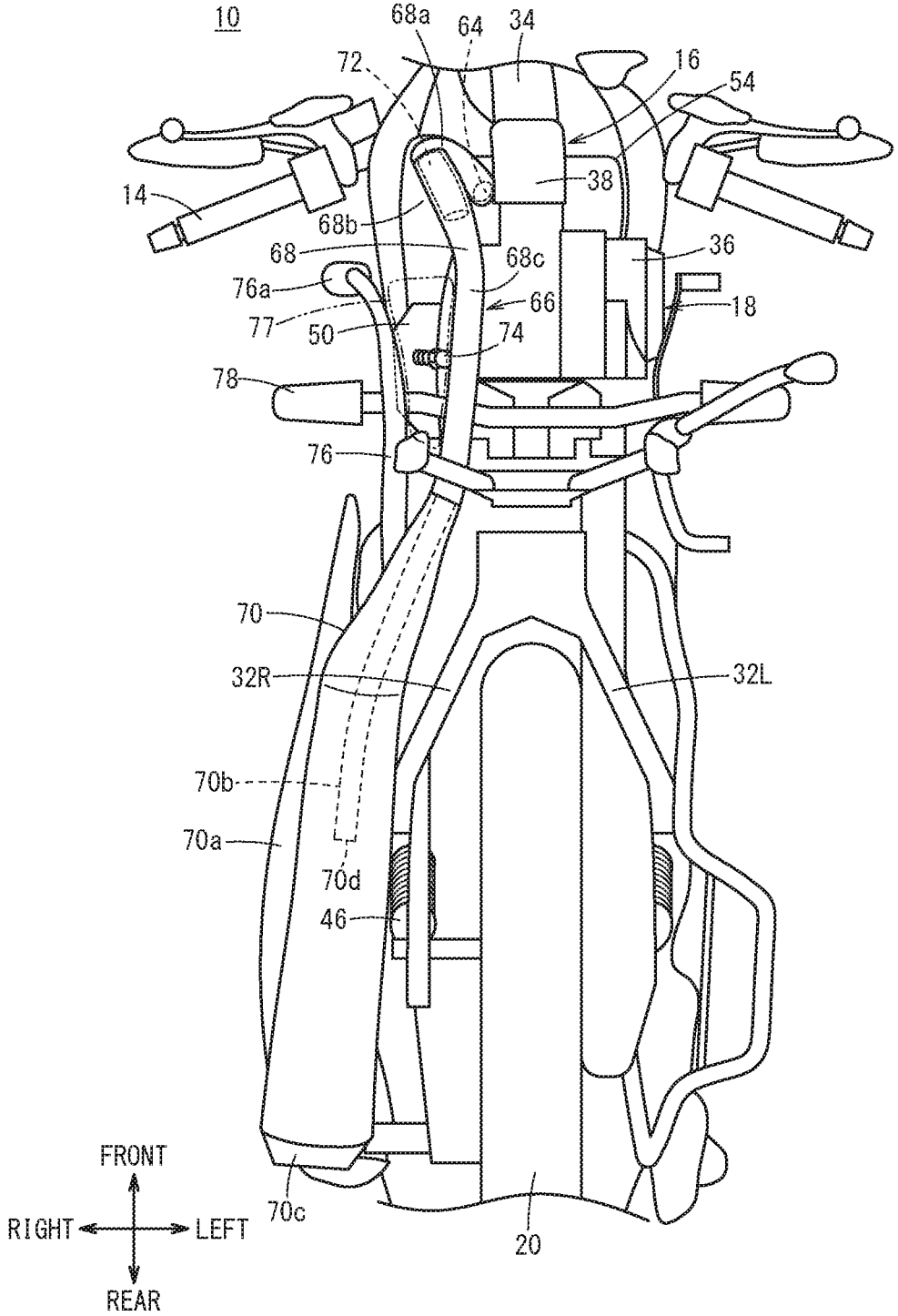
FIG. 3 is a partial plane view of the motorcycle in FIG. 1 seen from below.
Figure 4:
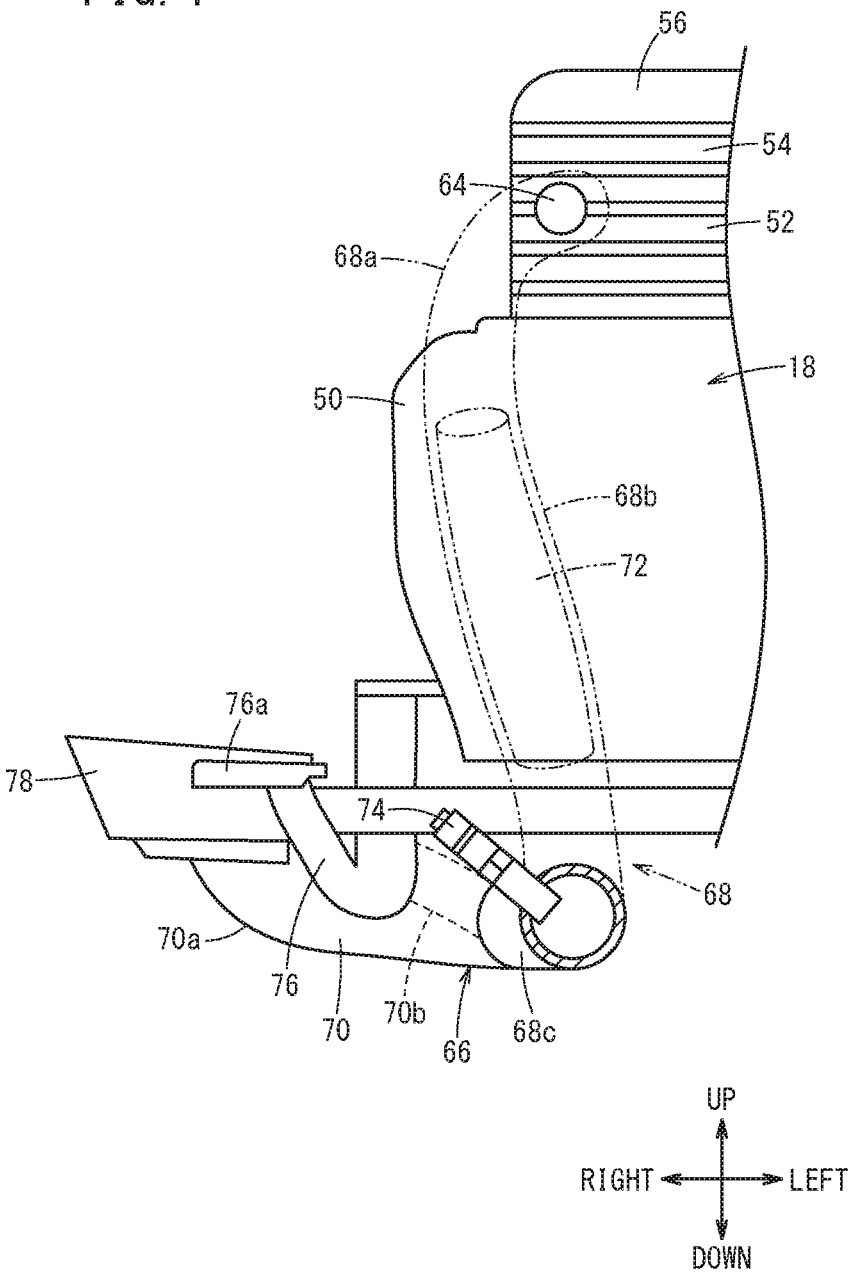
FIG. 4 is a partial front view in which the exhaust pipe in FIG. 1 has been broken.

In addition, the exhaust gas sensor 74 is attached to the downstream connection pipe part 68*c* so that at least a part of the exhaust gas sensor 74 overlaps with the internal combustion engine 18 in plane view in FIG. 3. More specifically, as illustrated in FIGS. 1 to 4, the exhaust gas sensor 74 is disposed below (the cover member 50 provided on the right side in the vehicle width direction of) the crankcase 36 of the internal combustion engine 18.

Further, in plane view in FIG. 3, the exhaust gas sensor 74 is attached to the downstream connection pipe part 68*c* so as to be disposed in the spatial region formed by connecting the front end part (the upstream connection pipe part 68*a*) of the first pipe part 68 to be connected to the exhaust port 64, the exhaust pipe 66, and the rear end part (a rear end part 70*c* of the muffler 70*a* or a rear end part 70*d* of the diffuser pipe 70*b*) of the second pipe part 70. More specifically, in plane view in FIG. 3, the exhaust gas sensor 74 is disposed in a spatial region 77 between the brake pedal 76 and portions of the first pipe part 68 and the second pipe part 70, the portions being inwardly bent in the vehicle width direction (the portions of the first pipe part 68 including the downstream connection pipe part 68*c* and the second pipe part 70 located toward the internal combustion engine 18). FIG. 3 schematically illustrates the range of the spatial region 77 by a two-dot chain line.

3. Effects of the Embodiment

As described above, the attachment structure according to the embodiment has the following effects via the structure described above.

In the attachment structure according to the embodiment, during operation of the motorcycle 10, the exhaust gas sensor 74 can be covered with the driver's foot or the like from the outside in the vehicle width direction. As a result, effects of an external force on the exhaust gas sensor 74 can be suppressed without separately providing a protective member such as a cover member.

In addition, by disposing the exhaust gas sensor 74 in the spatial region 75 formed by connecting the depressed part 76*a*, the footrest 78, and the brake pedal 76, the exhaust gas sensor 74 can be easily covered with the driver's foot or the like from the outside in the vehicle width direction during operation of the motorcycle 10. As a result, the exhaust gas sensor 74 can be more actively protected from an external force.

Further, by disposing the exhaust gas sensor 74 so that at least a part of the exhaust gas sensor 74 overlaps with the internal combustion engine 18 in plane view in FIG. 3, the presence of the internal combustion engine 18 can effectively prevent the driver's foot or the like from making contact with the exhaust gas sensor 74.

Furthermore, the crankcase 36 for protecting the internal combustion engine 18 can effectively protects the exhaust gas sensor 74 from an external force.

In addition, since the cover member 50 and the exhaust gas sensor 74 are arranged along the vertical direction, maintainability can be improved while the exhaust gas sensor 74 is protected from an external force by the cover member 50.

Further, since the exhaust gas sensor 74 is disposed so as to be inclined with respect to the vertical direction, the upper end of the exhaust gas sensor 74 can be set at a lower position and the degree of freedom of design can be improved.

In this case, since the exhaust gas sensor 74 is attached to (the downstream connection pipe part 68*c* of) the exhaust pipe 66 so as to extend obliquely upward from the exhaust pipe 66 toward the outside in the vehicle width direction, the exhaust gas sensor 74 can be attached to or detached from the right side (an outer side in the vehicle width direction) of the motorcycle 10, so maintenance becomes easy.

In addition, since the exhaust gas sensor 74 is disposed in the spatial region (space part) on the inner side in the vehicle width direction formed by the exhaust pipe 66, it is possible to prevent the exhaust gas sensor 74 from interfering with the operation of the motorcycle 10.

Further, since the exhaust gas sensor 74 is disposed, in plane view in FIG. 3, in the spatial region 77 between the brake pedal 76 and the portions of the first pipe part 68 and the second pipe part 70, the portions being inwardly bent in the vehicle width direction, it is possible to effectively prevent the exhaust gas sensor 74 from interfering with the operation of the motorcycle 10.

While the present invention has been described above by using the preferred embodiment thereof, the technical scope of the present invention is not limited to the above description of the embodiment. It is obvious to a person skilled in the art that various changes or improvements can be made to the above-described embodiment. As is clear from the description of the claims, any embodiment obtained by making such changes or improvements to the above-described embodiment can also be included in the technical scope of the present invention. Moreover, characters in parentheses described in the claims are the same as the characters in the attached drawings to facilitate understanding of the present invention and are not meant to limit the present invention to the elements identified with these characters.

What is claimed is:

1. An attachment structure for an exhaust gas sensor of a saddle-type vehicle including an internal combustion engine, an exhaust pipe connected to the internal combustion engine, and the exhaust gas sensor that is attached to the exhaust pipe and detects an exhaust gas flowing through the exhaust pipe, wherein the exhaust gas sensor is disposed in a region between a brake pedal of the saddle-type vehicle and a footrest of the saddle-type vehicle in a right side view of the saddle-type vehicle and at least a part of the exhaust gas sensor overlaps with the internal combustion engine in plane view, viewed from a bottom-side, of the saddle-type vehicle.

2. The attachment structure for the exhaust gas sensor according to claim 1, wherein in the right side view, the exhaust gas sensor is disposed in a region between the footrest and a depressed part provided at an end of the brake pedal.

3. The attachment structure for the exhaust gas sensor according to claim 1, wherein the exhaust gas sensor is disposed below a case of the internal combustion engine.

4. The attachment structure for the exhaust gas sensor according to claim 3, wherein the exhaust gas sensor is disposed below a cover member provided for the case on an outer side of a vehicle width direction of the saddle-type vehicle.

5. The attachment structure for the exhaust gas sensor according to claim 1, wherein the exhaust gas sensor is disposed obliquely with respect to a vertical direction of the saddle-type vehicle.

6. The attachment structure for the exhaust gas sensor according to claim 5, wherein the exhaust gas sensor is attached to the exhaust pipe, extending obliquely upward from the exhaust pipe toward the outer side in the vehicle width direction of the saddle-type vehicle.

7. The attachment structure for the exhaust gas sensor according to claim 1, wherein the exhaust pipe includes a first pipe part that extends toward rear of the saddle-type vehicle from an exhaust port of the internal combustion engine while being inclined to an inner side in the vehicle width direction of the saddle-type vehicle, and a second pipe part that is joined to a rear end part of the first pipe part and extends toward the rear of the saddle-type vehicle while being inclined to an outer side in the vehicle width direction, and the exhaust gas sensor is disposed in a region formed by connecting a front end part of the first pipe part to be connected to the exhaust port, the exhaust pipe, and rear end parts of the second pipe part in plane view of the saddle-type vehicle.

8. The attachment structure for the exhaust gas sensor according to claim 7, wherein in the plane view, the exhaust gas sensor is disposed in a region between the brake pedal and portions of the first pipe part and the second pipe part, the portions being inwardly bent in the vehicle width direction of the first pipe part and the second pipe part.

9. The attachment structure for the exhaust gas sensor according to claim 1, wherein the exhaust pipe includes an upstream connection pipe part that extends from a cylinder head of the internal combustion engine, a cylindrical catalyst outer cylinder that is connected to a rear end part of the upstream connection pipe part and houses a catalyst, and a downstream connection pipe part that is connected to a rear end part of the catalyst outer cylinder, the downstream connection pipe part is provided with the exhaust gas sensor.

* * * * *